US006712501B2

(12) United States Patent
Kinkio et al.

(10) Patent No.: US 6,712,501 B2
(45) Date of Patent: Mar. 30, 2004

(54) DEVICE FOR ATTACHING WRISTBAND STRANDS TO A CASE

(75) Inventors: Stéphane Kinkio, Neuchâtel (CH); Steeve Gerber, La'Neuveville (CH); Clément Meyrat, Le Landeron (CH)

(73) Assignee: The Swatch Group Management Services AG, Biel (CH)

( * ) Notice: Subject to any disclaimer, the term of this patent is extended or adjusted under 35 U.S.C. 154(b) by 85 days.

(21) Appl. No.: 10/179,850

(22) Filed: Jun. 26, 2002

(65) Prior Publication Data

US 2003/0002394 A1 Jan. 2, 2003

(30) Foreign Application Priority Data

Jun. 27, 2001 (CH) ..... 2001 1187/01

(51) Int. Cl.[7] ..... A44C 5/00; A44C 5/14; G04B 37/00

(52) U.S. Cl. ..... 368/281; 368/282; 224/169

(58) Field of Search ..... 368/281–282; 224/164, 167, 169

(56) References Cited

U.S. PATENT DOCUMENTS 4,034,552 A * 7/1977 Davidson ..... 368/280
4,903,253 A * 2/1990 Nikles et al. ..... 368/282
5,158,219 A * 10/1992 Baumgartner et al. ..... 224/164
5,341,552 A * 8/1994 Voumard ..... 29/896.33

FOREIGN PATENT DOCUMENTS

CH 347490 * 8/1960
DE 8509275 U * 5/1985
DE 3725960 * 2/1989

* cited by examiner

*Primary Examiner*—Vit W. Miska
(74) *Attorney, Agent, or Firm*—Sughrue Mion, PLLC

(57) ABSTRACT

Each wristband strand (10, 20) includes at least two studs (12, 14, . . . ) extending perpendicularly to the inner surface of said strand and is each pierced in its median part by a hole (12*a*, 14*a*, . . . ) of parallel axis to the strand, each side of the middle part includes recesses (15, 17, . . . ), complementary to the studs including through passages (15*a*, 17*a*, . . . ) on the back cover side and blind holes on the crystal side. The studs are fitted into recesses, and locked with U shaped parts (18,28) engaged on the back side cover through the through passages, the holes of the studs and the blind hole. If one desires, this assembly enables a portion of the middle part located at 6 o'clock and/or 12 o'clock to be left entirely free of any attaching means.

10 Claims, 2 Drawing Sheets

DEVICE FOR ATTACHING WRISTBAND STRANDS TO A CASE

The present invention concerns a device for attaching the strands of a wristband or bracelet to a case, and particularly to the middle part of a watchcase. The invention concerns more particularly a device of this kind wherein the attaching means leave free a portion of the middle part between zones for anchoring the wristband strands, while allowing said wristband to be easily interchanged, without having to use special tools.

A watch wristband is generally attached to the case by means of bars which pass through the ends of the wristband strands and are fixed to horns secured to the middle part or to extensions of said horns.

These bars are usually so called "spring" lugs, including a tube housing a helical spring pressing at each end on two pivots which can thus be compressed and pulled back to lock into blind recesses provided in the horns. With such a system of attachment, the wristband can only be replaced by a professional using a special tool, for example tweezers. This system is thus ill suited to current market tendencies (large scale distribution, mail-order selling), which less and less frequently require professional intervention for banal operations, and to the requirements of the consumer who may wish to replace the wristband himself at any time of the day with another wristband, for example to match his clothing.

The attachment devices disclosed in U.S. Pat. Nos. 4,561,077 and 4,624,581 provide a solution in that attachment is achieved using a hinge, which, on extensions of the middle part and on the ends of the wristband strands, includes two series of overlapping teeth, the assembly being secured by a metal rod passing through the two rows of teeth, driven into the teeth of the wristband and free to rotate in the teeth of the middle part.

In order to replace the wristband, the rod simply has to be pushed back into place, for example using another rod or the point of a needle.

Other devices for attaching a wristband to a case have also been proposed or used, amongst which those disclosed in the following documents can be cited in a non-limiting manner.

In Swiss Patent document No. 350610, the bar is also a metal rod, but has a central thinned portion allowing it to be bent and its ends to be engaged by force into blind holes provided in the horns. Swiss Patent document No. 682875 provides only one blind hole, the other hole being open onto the middle part to enable the rod to engage therein and then be held in place by being screwed from the back cover. In Swiss Patent No. 503311, a metal lug, of generally open rectangular shape, is embedded in each wristband strand end to snap into blind holes provided in the middle part. German Utility Model No. 8 509 275 discloses an attachment device wherein the lower face of the end of each wristband strand includes studs, which engage in recesses of an extension of the middle part and are locked in by staples passing through said studs and recess along a direction parallel to the back cover of the case.

It can be seen that in all these attachment devices, a part of the attachment element, bar, rod or metal lug always passes in front of the middle part at the 6 o'clock or 12 o'clock positions, which may present drawbacks in certain applications, for example for positioning a lens of a micro-camera, integrated in a watchcase, on the middle part. It will also be observed that these attachment devices, which enable a wristband to be replaced without intervention by a professional, are generally unattractive, or at least visible when the watch is worn on the wrist.

The main object of the invention is thus to overcome the drawbacks of the aforecited prior art by providing a device for attaching wristband strands to a case which enables an ordinary user to change the wristband easily, which does not detract from the aesthetic appearance of the watch and which can preferably leave portions of the middle part at 12 o'clock and/or 6 o'clock free of any attachment element.

The invention therefore concerns a device for attaching wristband strands to each side of the middle part of a watchcase without horns, closed by a back cover and by a crystal delimiting a space in which at least a watch movement is housed for a digital or analogue time display. The inner surface of each wristband strand end includes at least two studs extending perpendicularly to said surface and each being pierced in their median part by a hole along a direction parallel to the length of the strand. Each side of the middle part includes at least as many recesses as studs, complementary to the studs, in inner volume and positioning, each recess having in its median part perpendicular to the back cover of the case, a through passage on the back cover side and a blind hole on the crystal side. After the studs have been fitted into the recesses, each strand is secured to the middle part by engaging a staple, including as many branches as studs, through the through passages, the holes of the studs and the blind holes.

Before setting the securing staple in place, each wristband strand is positioned perpendicularly to the back cover. By simply pressing with the fingers along the 6 o'clock-12 o'clock direction, it is easy to fit the studs into the recesses, an operation which would be more difficult to perform if the studs were located at the very end of the strand.

The studs are preferably made of a plastic material and the holes which pass through them have a slightly smaller diameter to that of the branches of the staple, which enables said staple to be locked in after being set in place. Conversely, the through passage and the blind hole of the middle part have a slightly greater diameter to that of the branches of the staple, which reduces the effort required to remove it when the user wishes to replace the wristband.

According to a preferred embodiment, the staple has only two branches and the wristband strand two studs, such that the portion of middle part located between the two attachment zones is entirely free of any attachment means. The attachment device according to the invention thus has the advantage of making the middle part portions located substantially at 12 o'clock and 6 o'clock accessible for other arrangements. In the case of a calculator or diary watch having a keyboard on a wristband strand, the device allows the electric connections to be more easily made through a hole made in the middle part. In the case of a camera watch, it is possible to arrange the lens at the 12 o'clock position by providing a U-shaped scalloping in the end of the wristband strand.

Other features and advantages of the invention will appear more clearly upon reading the following description of embodiments of the invention, given purely by way of non-limiting illustration, with reference to the annexed drawings, in which.

Figure 1:
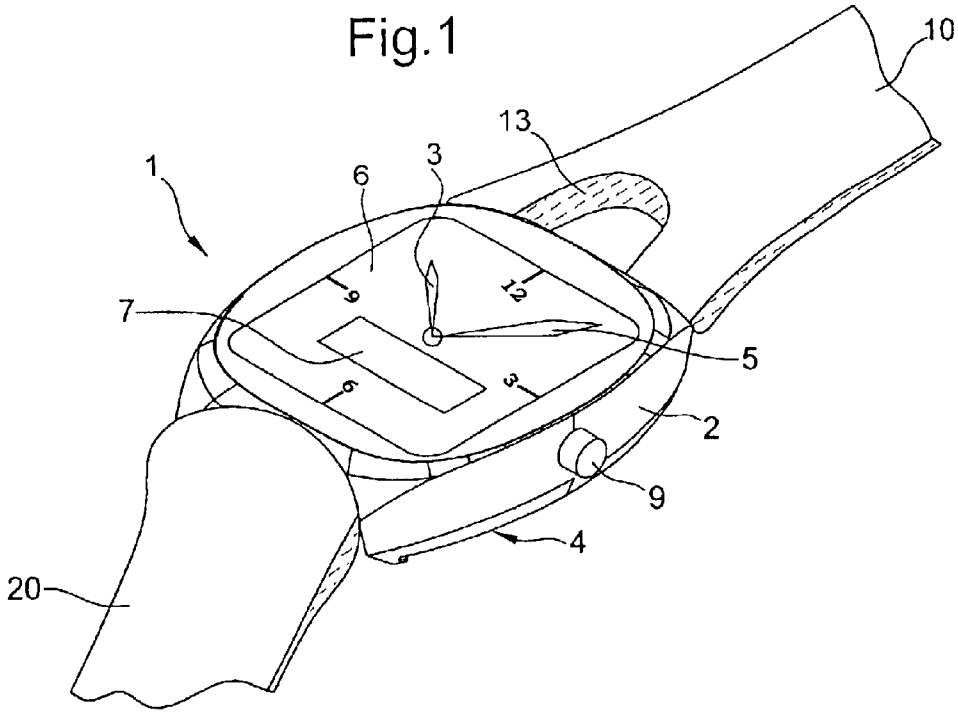
FIG. 1 is a perspective view of a watch having the two strands secured to the middle part.

FIG. 1 shows in perspective a wristwatch 1, including a middle part 2 of generally rectangular shape, closed by a back cover 4 and by a crystal 6 arranged above a dial for an analogue time display by means of hands 3, 5, driven by a watch movement (not shown). The dial may also include a digital display aperture 7 for providing complementary time-related information or non time-related information for mechanisms or sensors contained in case 1 with the movement, these elements being neither shown nor described any further since they are well known to those skilled in the art and do not directly form part of the invention. Digital display aperture 7 is for example the viewfinder of a micro-camera integrated in the watch. The wristwatch may be placed around the wrist using two wristband strands 10, 20 attached to middle part 2 by the attachment device according to the invention, these strands being joined by any clasp (not shown), known to those skilled in the art.

Figure 2:
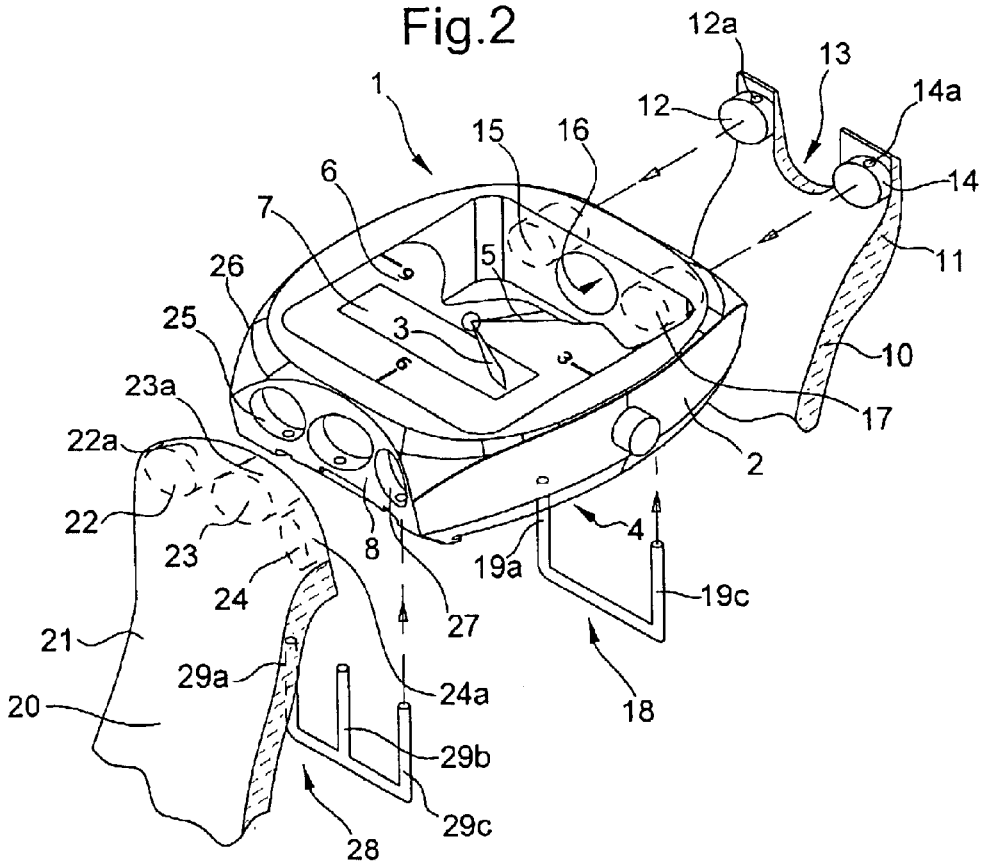
FIG. 2 is a blown up perspective view of the attachment device according to the invention for the watch shown in FIG. 1.
Figure 3:
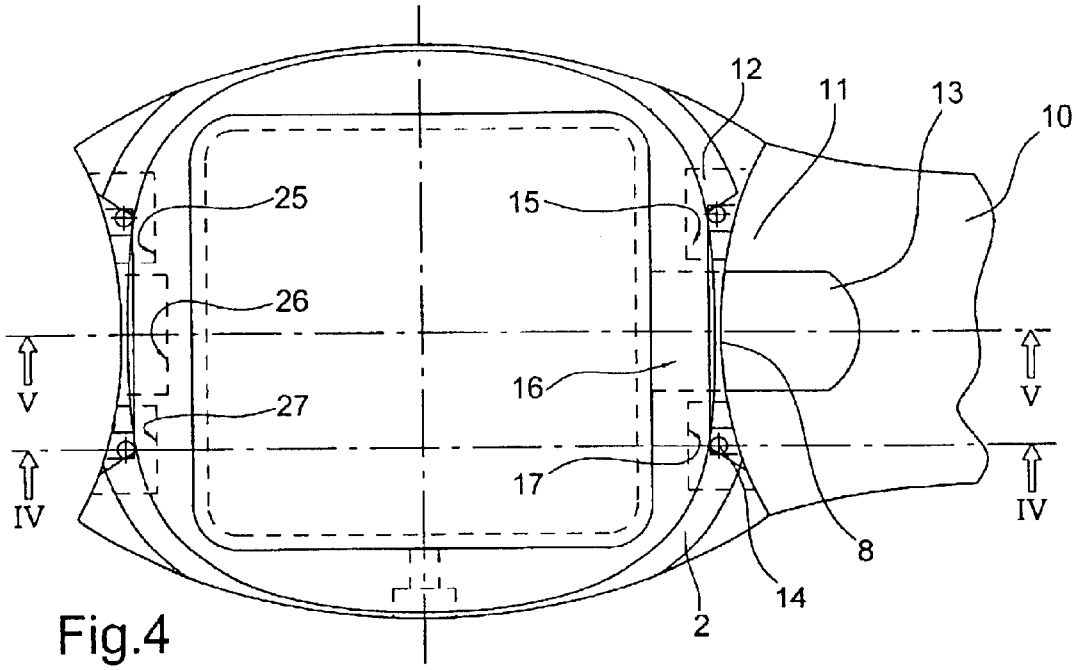
FIG. 3 shows a top view of an embodiment for attaching a wristband strand to the middle part of a watchcase.
Figure 4:
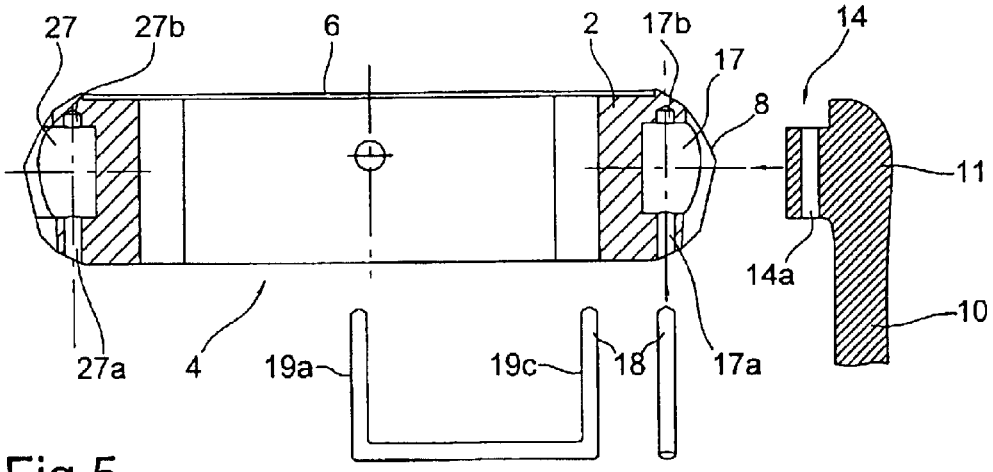
FIG. 4 is a cross-section along the line IV—IV of FIG. 3.
Figure 5:
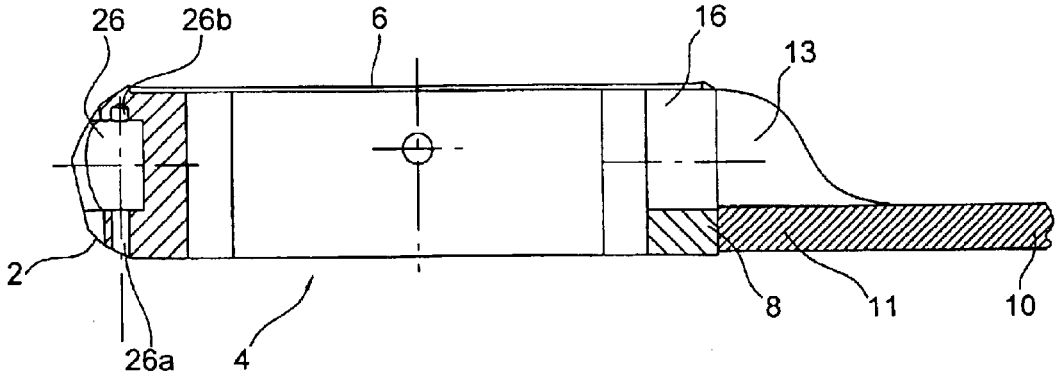
FIG. 5 is a cross-section along the line V—V of FIG. 3.

The attachment device is described in more detail hereinafter with reference to FIGS. 2 to 5. FIG. 2 shows in blown up perspective the same wristwatch as that shown in FIG. 1 with an attachment variant for each wristband strand. It can be seen that strand 10 which has to be attached to middle part 2 at the 12 o'clock position includes in the inner surface of reinforced end 11 and close to each end a cylindrical stud 12, 14, each stud being pierced in its median part with a hole 12*a*, 14*a* along a direction parallel to the length of the wristband. It is clear that the contour of studs 12, 14 could be different, for example oval or quadrangular shaped Also with reference to FIGS. 3 to 5, it can be seen that middle part 2 includes recesses 15, 17, which are complementary in shape and positioning, to studs 12, 14. Recesses 15, 17 may pass completely through middle part 2, but according to a preferred embodiment, said recesses 15, 17 are blind. In the median parts of recesses 15, 17, through passages 15*a*, 17*a* on the side of back cover 4, and blind holes 15*b*, 17*b* on the side of crystal 6 are arranged in middle part 2 to enable, after studs 12, 14 have been fitted into recesses 15, 17, a staple 18 with two branches 19*a*, 19*c* to be engaged successively through through passages 15*a*, 17*a*, holes 12*a*, 14*a* of the studs and blind holes 15*b*, 17*b*. In order for staple 18 to remain in place, studs 12, 14 are preferably made of flexible plastic material with holes 12*a*, 14*a* of slightly smaller diameter to the diameter of branches 19*a*, 19*c* of staple 18. Conversely, the diameter of through passages 15*a*, 17*a* and of blind holes 15*b*, 17*b* may be slightly greater than the diameter of branches 19*a*, 19*c* so as to facilitate installation and removal of staple 18, for example simply with the end of a pointed object, such as a knife.

Equally, the locking of staple 18 can be reversed, i.e. it can be effected at through passages 15*a*, 17*a* and/or blind holes 15*b*, 17*b*. In the case of a middle part made of a hard material, such as a metal or a ceramic material, the inside of the passages or holes will advantageously be lined with a small length of plastic sheathing.

In a preferred embodiment, studs 12, 14 are integral with a plastic material part forming wristband strand 10, such that, after being attached, it can easily be bent around the wrist. It is of course possible to integrate these studs 12, 14 in the last link of an articulated bracelet, whether it is made of metal, ceramic or rigid synthetic material.

FIGS. 1 to 3 and 5 also show that no part of staple 18 passes through the middle part portion 8 between the zones for attaching studs/recesses, which enables it to be used for arrangements through middle part 2. In the example shown, this middle part portion 8 includes an orifice 16, which allows the inside and outside of case 1 to communicate, said orifice 16 being able to be sealed by the lens of a micro-camera (not shown).

To clear the field of this lens, end 11 of wristband strand 10 includes a scalloping 13, which is possible given that there are no attaching means at this location. It is evident that an arrangement of this type could be provided on the middle part portion located at 6 o'clock, with or without a scalloping in strand 20, for example for the passage of electric connections to a keyboard which would be provided on the wristband strand, for example in the case of a calculator watch.

Returning to FIG. 2, at the 6 o'clock position there is shown an attachment device which differs from that which has just been described in that the reinforced part 21 of the end of wristband strand 20 includes in its inner surface three studs 22, 23, 24 each pierced as before with a hole 22*a*, 23*a*, 24*a*, and the corresponding middle part portion includes three recesses 25, 26, 27 each provided with through passages 25*a*, 26*a*, 27*a* and blind holes 25*b*, 26*b*, 27*b*. Staple 28, which assures the connection between strand 20 and portion 8 of middle part 2, then includes three branches 29*a*, 29*b*, 29*c*. This variant no longer has the advantages of the preceding construction, which has only two studs, given that median branch 29*b* of staple 28 passes through the middle part substantially at the 6 o'clock position. Conversely, the attachment of wristband strand 20 is reinforced, which may be an advantage if the watch functions do not require the inside and outside of the case to communicate with each other. For aesthetical reasons, it is preferably for the two wristband strands to have the same shape, but they may also be different, as shown in FIG. 2.

The preceding description concerns a case of generally rectangular shape, such that the studs and the recesses are aligned along directions substantially parallel to the length of the wristband. The attachment device is also suited to watchcases of generally round or oval shape, the studs and recesses then being aligned in directions concurrent to the center of the case. In this latter case, staple 18 or 28 may have the shape shown in FIG. 2, but the element for joining the branches may also have a curve corresponding to the curve of the case at the junction.

What is claimed is:

1. A device for attaching wristband strands to each side of the middle part of a watchcase without horns, closed by a back cover and by a crystal, wherein the inner surface of each wristband strand end includes at least two studs extending perpendicularly to said surface and each being pierced in their median part by a hole along a direction parallel to the length of the strand, in that each side of the middle part includes at least as many recesses as studs, said recesses being complementary to the studs in volume and positioning, each recess having in its median part perpendicular to the back cover, a through passage on the back cover side and a blind hole on the crystal side, and in that a staple, including as many branches as studs at each strand is engaged, on the back cover side, after the studs have been fitted into the recesses, through the through passages, the holes of the studs and the blind holes.

2. The attachment device according to claim 1, wherein the diameter of the branches of the staples is slightly greater than the diameter of the hole in the studs and substantially less than the diameter of the through passage and of the blind hole opening out into the recesses of the middle part.

3. The attachment device according to claim 1, wherein at least one of the strands has only two studs close to the edges of said strand and includes a U-shaped scalloping in its median part between the studs.

4. The attachment device according to claim 3, wherein the side of the middle part to which the strand with two studs is attached further includes facing the U-shaped scalloping an orifice through the middle part causing the inside and outside of the case to communicate with each other.

5. The attachment device according to claim 4, wherein the orifice in the middle part is sealed by the lens of a micro-camera housed in the case.

6. The attachment device according to claim 1, wherein the recesses in the middle part are blind holes.

7. The attachment device according to claim 1 wherein the middle part of the case has a generally rectangular or square shape, wherein the studs and the recesses are aligned along a direction substantially parallel to the 12 o'clock-6 o'clock direction.

8. The attachment device according to claim 1, wherein the middle part of the case has a generally round or oval shape, wherein the studs and the recesses are aligned along directions substantially concurrent with the center of the case.

9. The attachment device according to claim 1, wherein the studs are made of a plastic material integral with the wristband strand.

10. The attachment device according to claim 1, wherein the studs are made of a plastic material added to the last link of a wristband strand.

* * * * *